US007973628B1

(12) United States Patent
MacLennan

(10) Patent No.: US 7,973,628 B1
(45) Date of Patent: Jul. 5, 2011

(54) METHODS AND APPARATUS FOR ELECTRICAL COMPONENTS

(75) Inventor: Grant MacLennan, Scottsdale, AZ (US)

(73) Assignee: CTM Magnetics, Inc., Tempe, AZ (US)

( * ) Notice: Subject to any disclaimer, the term of this patent is extended or adjusted under 35 U.S.C. 154(b) by 700 days.

(21) Appl. No.: 12/098,880

(22) Filed: Apr. 7, 2008

Related U.S. Application Data

(63) Continuation-in-part of application No. 11/156,080, filed on Jun. 17, 2005, now Pat. No. 7,471,181.

(60) Provisional application No. 60/910,333, filed on Apr. 5, 2007, provisional application No. 60/580,922, filed on Jun. 17, 2004.

(51) Int. Cl.
*H01F 27/08* (2006.01)

(52) U.S. Cl. ..... 336/55

(58) Field of Classification Search ..... 336/55–65, 336/212, 225, 229, 220–223; 323/222; 363/16–17
See application file for complete search history.

(56) References Cited

U.S. PATENT DOCUMENTS

| | | | | |
|---|---|---|---|---|
| 3,374,452 | A | 3/1968 | Judd | |
| 3,377,582 | A | 4/1968 | Rogers | |
| 3,668,589 | A | 6/1972 | Wilkinson | |
| 4,393,435 | A | 7/1983 | Petrina | |
| 4,547,713 | A | 10/1985 | Langley et al. | |
| 4,639,626 | A | 1/1987 | McGee | |
| 4,710,667 | A | 12/1987 | Whiteley | |
| 5,256,211 | A * | 10/1993 | Silgailis et al. | 148/108 |
| 5,444,229 | A | 8/1995 | Rudolph et al. | |
| 5,481,238 | A * | 1/1996 | Carsten et al. | 336/214 |
| 5,543,674 | A | 8/1996 | Koehler | |
| 5,543,773 | A | 8/1996 | Evans et al. | |
| 5,868,123 | A | 2/1999 | Hasegawa et al. | |
| 6,154,109 | A | 11/2000 | Gold | |
| 6,166,472 | A | 12/2000 | Pinkerton et al. | |
| 6,648,990 | B2 | 11/2003 | Yoshizawa | |
| 6,897,718 | B2 | 5/2005 | Yoshida et al. | |

* cited by examiner

*Primary Examiner* — Tuyen Nguyen
(74) *Attorney, Agent, or Firm* — The Noblitt Group, PLLC

(57) ABSTRACT

Methods and apparatus according to various aspects of the present invention may operate in conjunction with an inductor. For example, n inverter/converter system according to various aspects of the present invention may include an inductor comprising a substantially annular core and a winding. The inductor may be configured for high current applications and exhibit a permeability of less than thirteen delta Gauss per delta Oersted at a load of four hundred Oersteds.

38 Claims, 16 Drawing Sheets

METHODS AND APPARATUS FOR ELECTRICAL COMPONENTS

CROSS-REFERENCES TO RELATED APPLICATIONS

This application claims benefit of U.S. Provisional Patent Application Ser. No. 60/910,333, filed on Apr. 5, 2007 entitled METHODS AND APPARATUS FOR ELECTROMAGNETIC COMPONENTS, and is a continuation-in-part of U.S. patent application Ser. No. 11/156,080, filed on Jun. 17, 2005 entitled METHODS AND APPARATUS FOR ELECTROMAGNETIC COMPONENTS, now U.S. Pat. No. 7,471,181, which claims the benefit of U.S. Provisional Patent Application Ser. No. 60/580,922, filed Jun. 17, 2004 entitled METHODS AND APPARATUS FOR ELECTROMAGNETIC COMPONENTS, and incorporates the disclosure of each such application in its entirety by reference.

BACKGROUND OF THE INVENTION

Electromagnetic components are used in a variety of applications. In many industrial applications, electromagnetic components, such as inductors, are integral components in a wide array of machines. Conventional silicon iron steel inductors have limits on inductance as a function of specified cost, space, and weight. Inductors having increased inductance at lower costs, manufacturable in a tighter space, having higher efficiencies, and/or having less weight are highly sought after and needed in a variety of industries.

SUMMARY OF THE INVENTION

Methods and apparatus according to various aspects of the present invention may operate in conjunction with an inductor. For example, an inverter/converter system according to various aspects of the present invention may include an inductor comprising a substantially annular core and a winding. The inductor may be configured for high current applications and exhibit a permeability of less than thirteen delta Gauss per delta Oersted at a load of four hundred Oersteds.

BRIEF DESCRIPTION OF THE DRAWING FIGURES

Figure 4A:
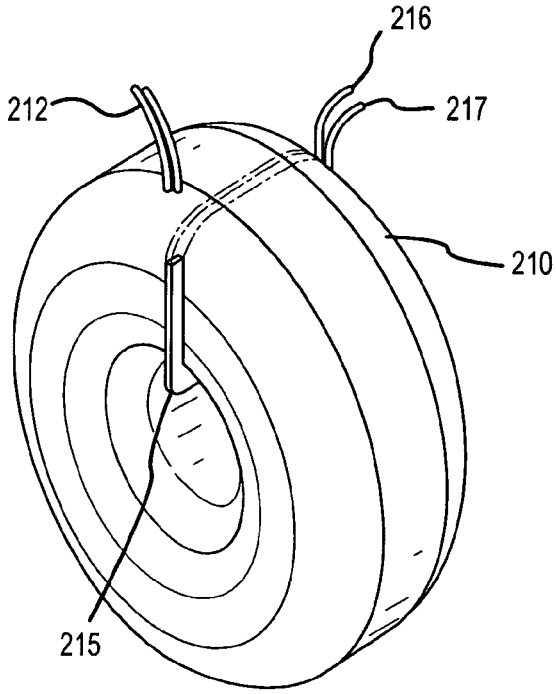
Figure 4B:
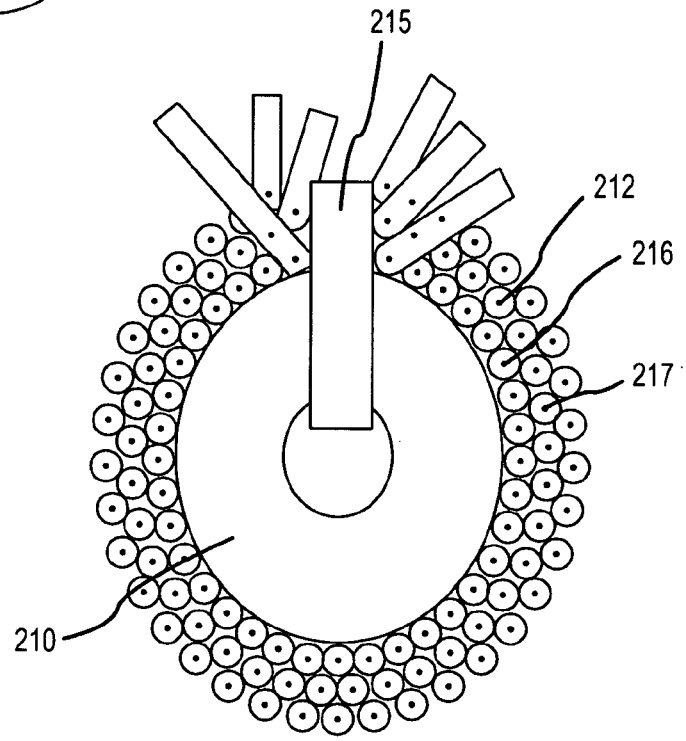
Figure 5A:
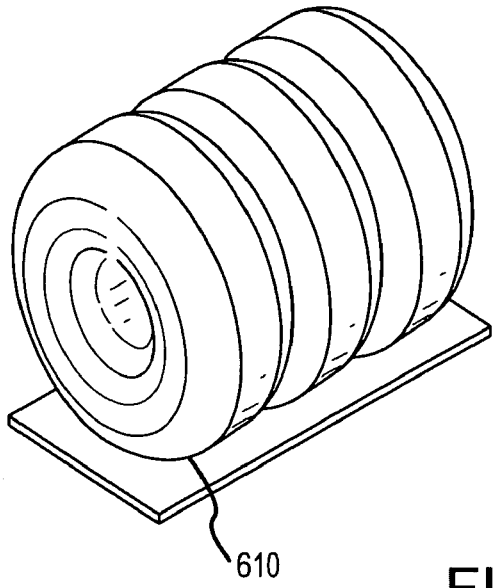
Figure 5B:
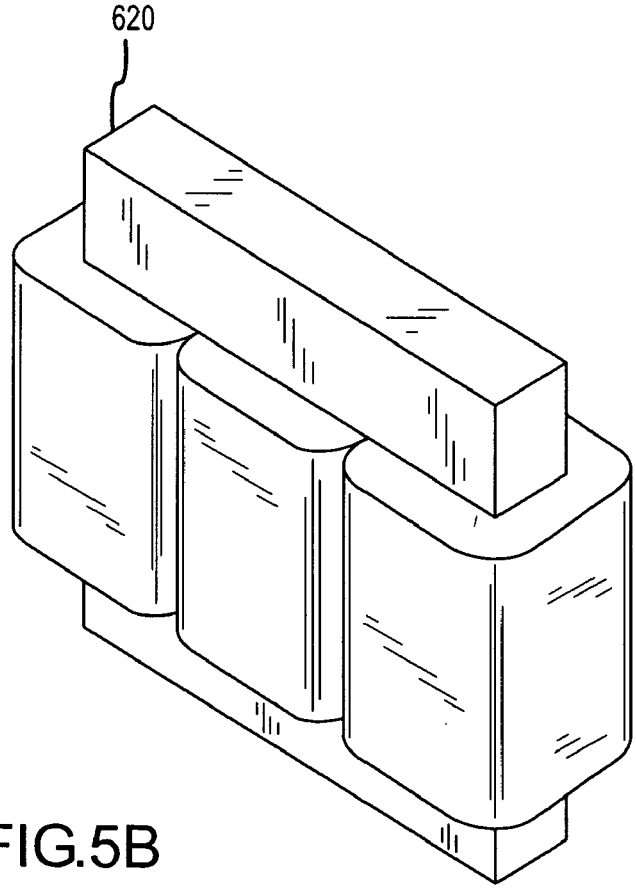
Figure 6:
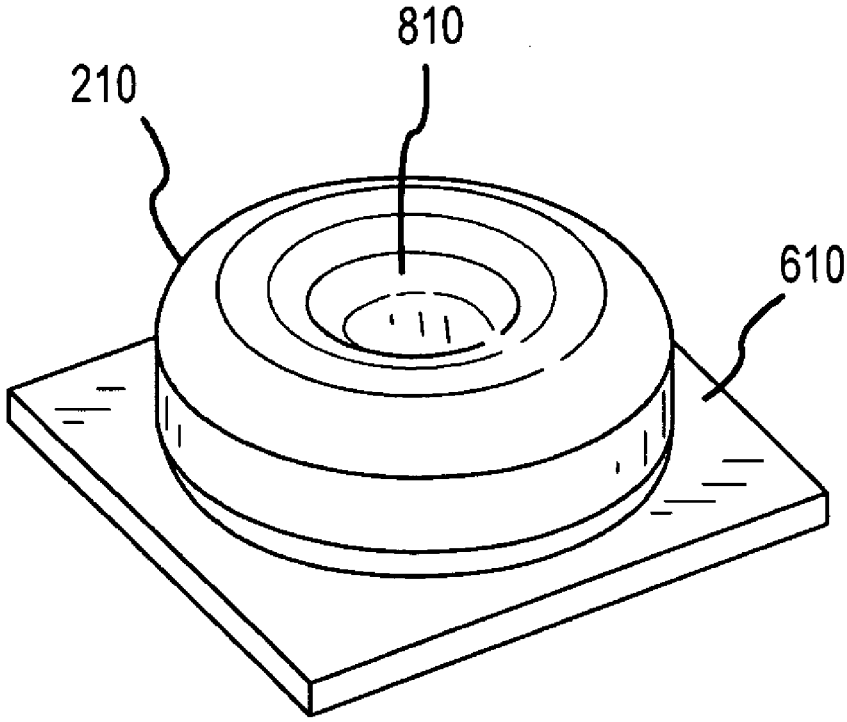
Figure 7A:
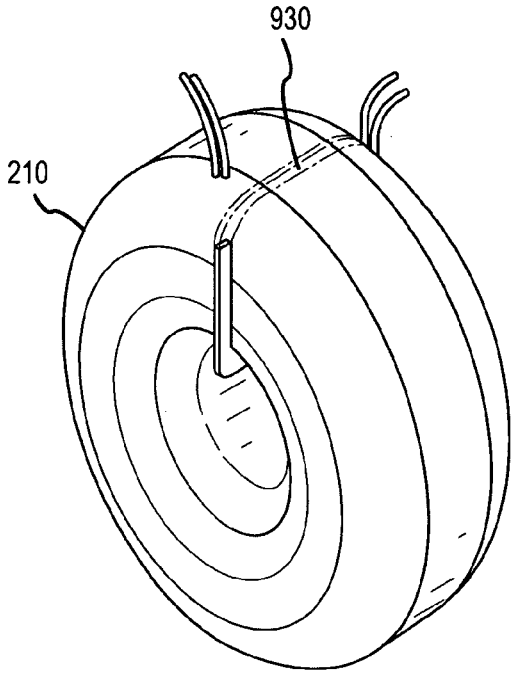
Figure 7B:
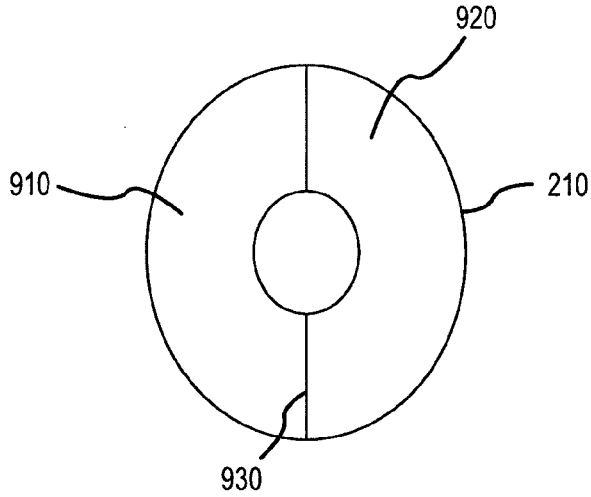
Figure 8:
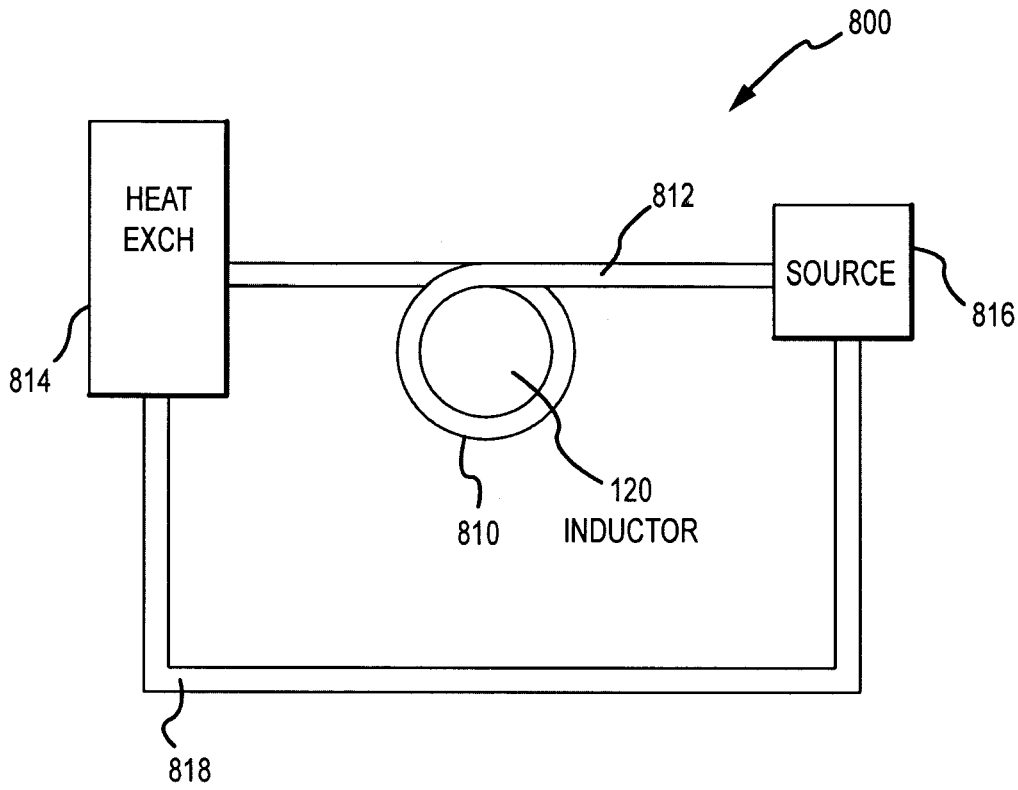
Figure 9:
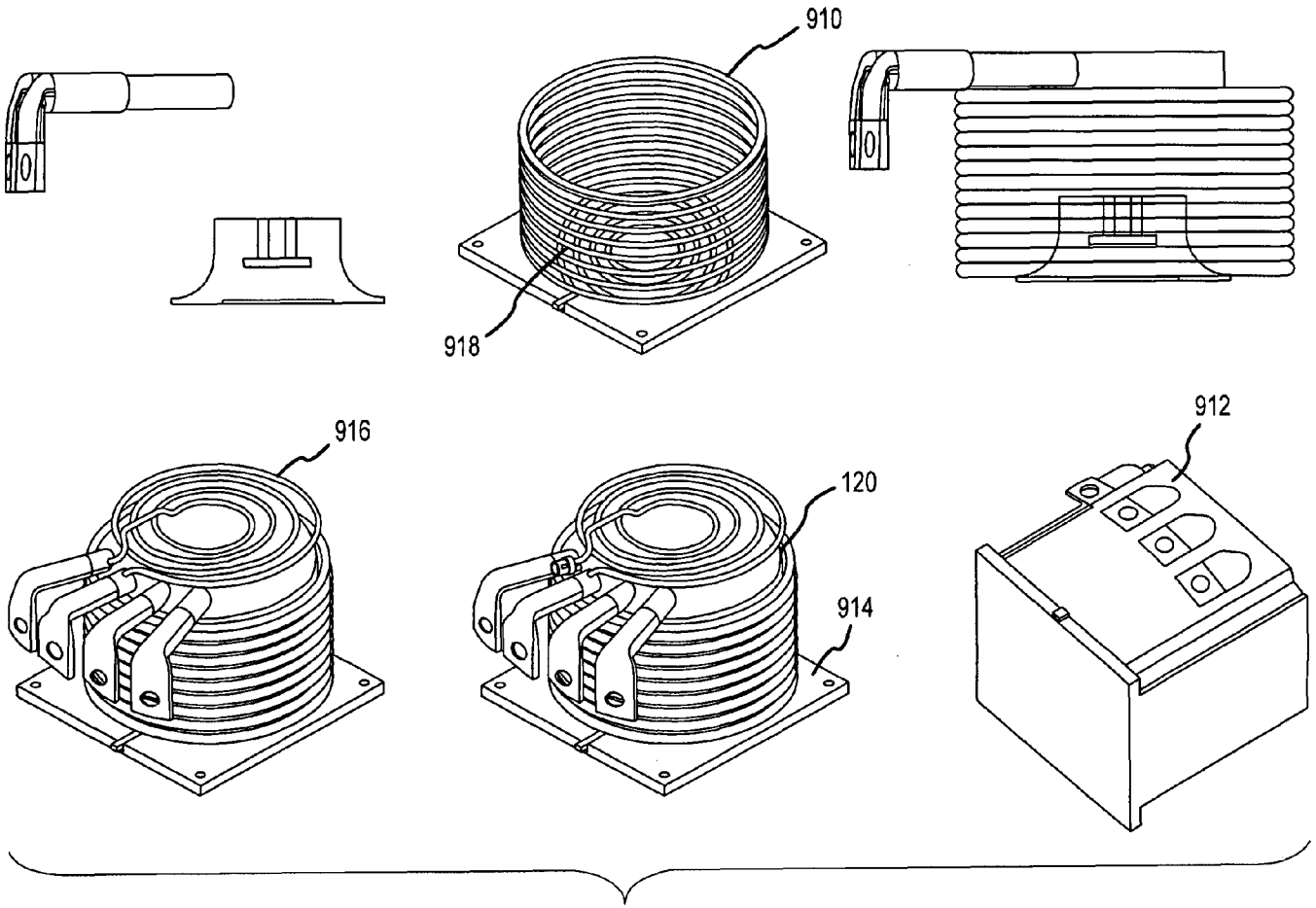
Figure 10:
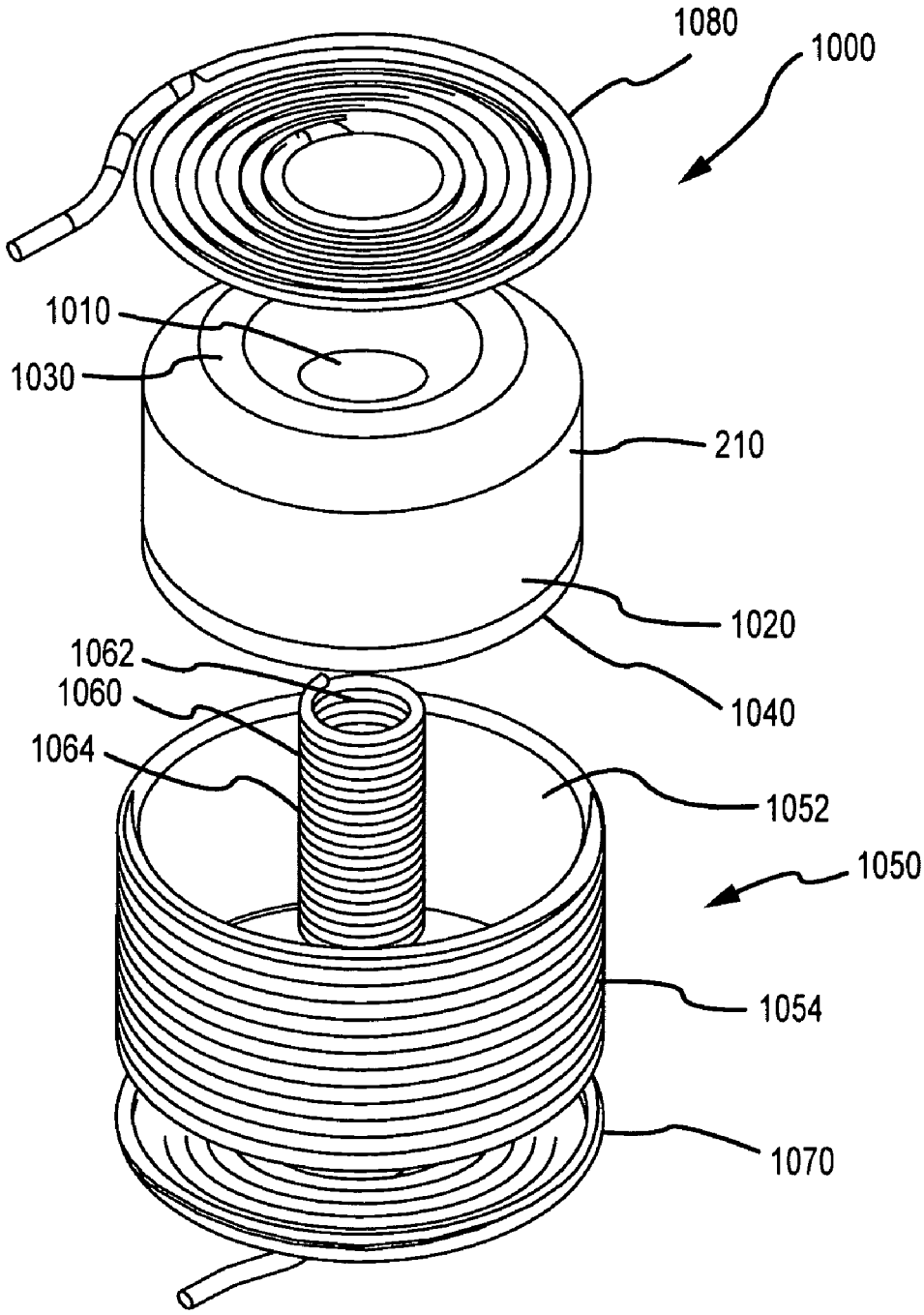
Figure 11:
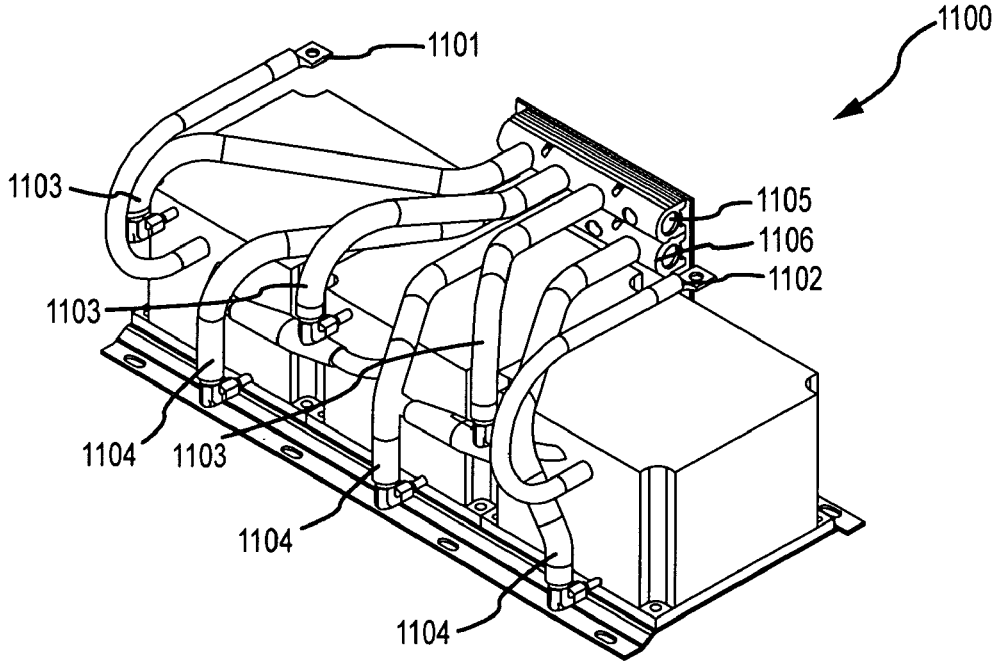
Figure 12:
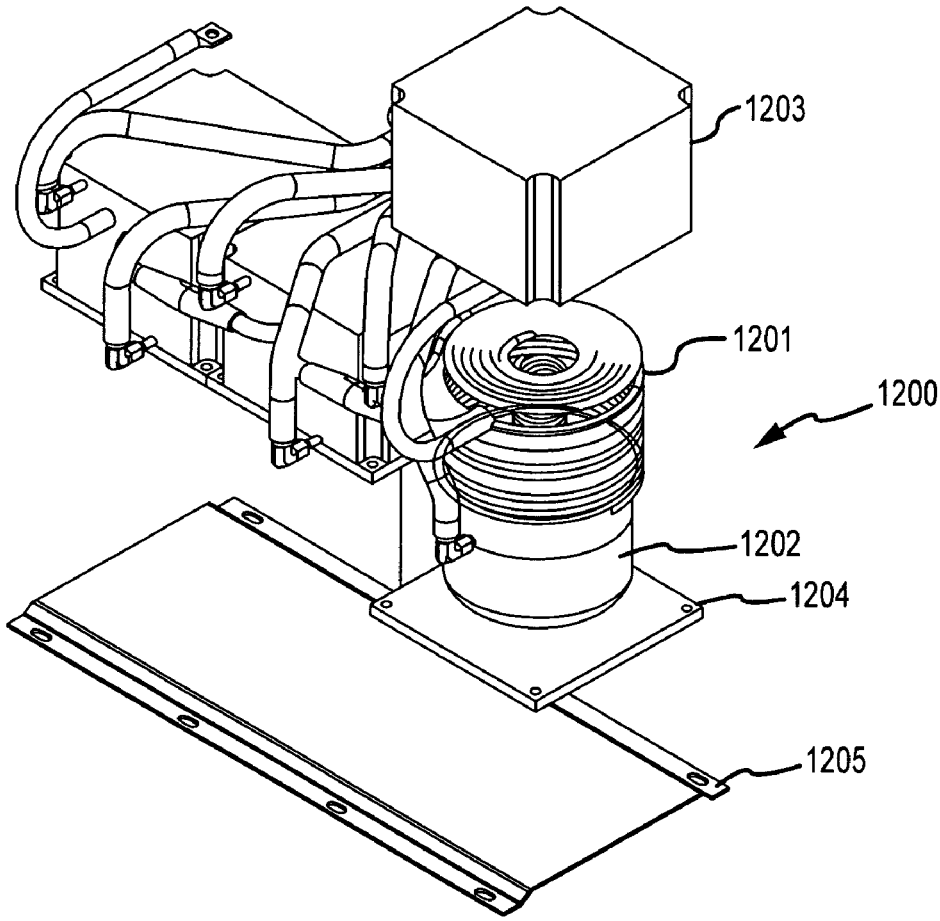
Figure 13:
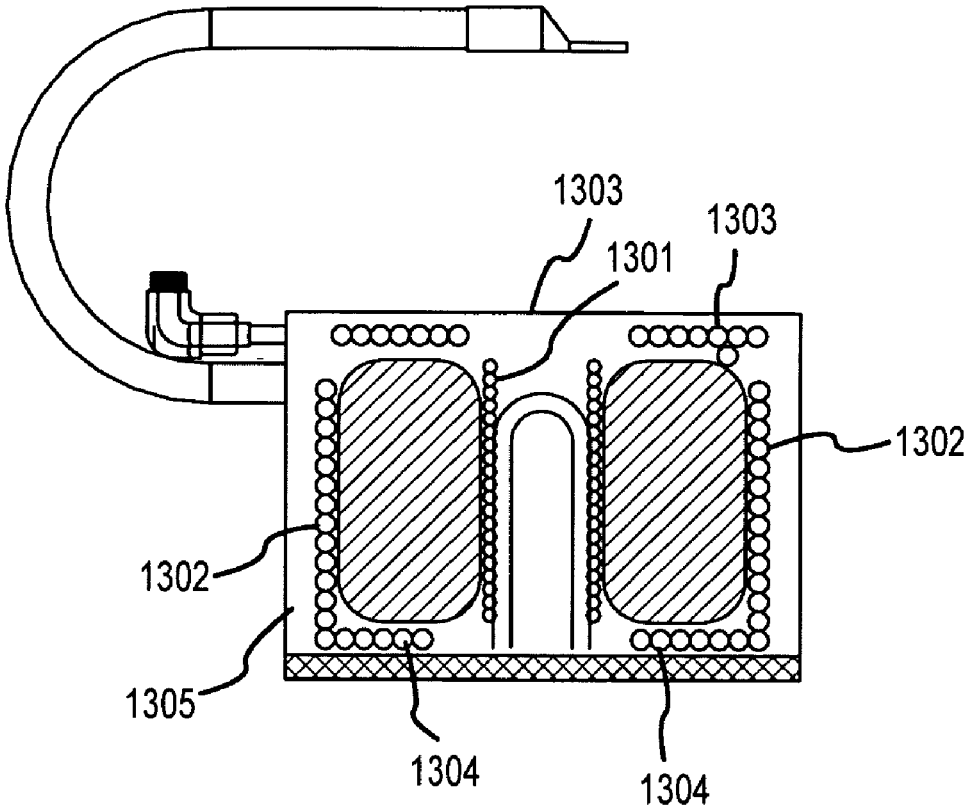
Figure 14:
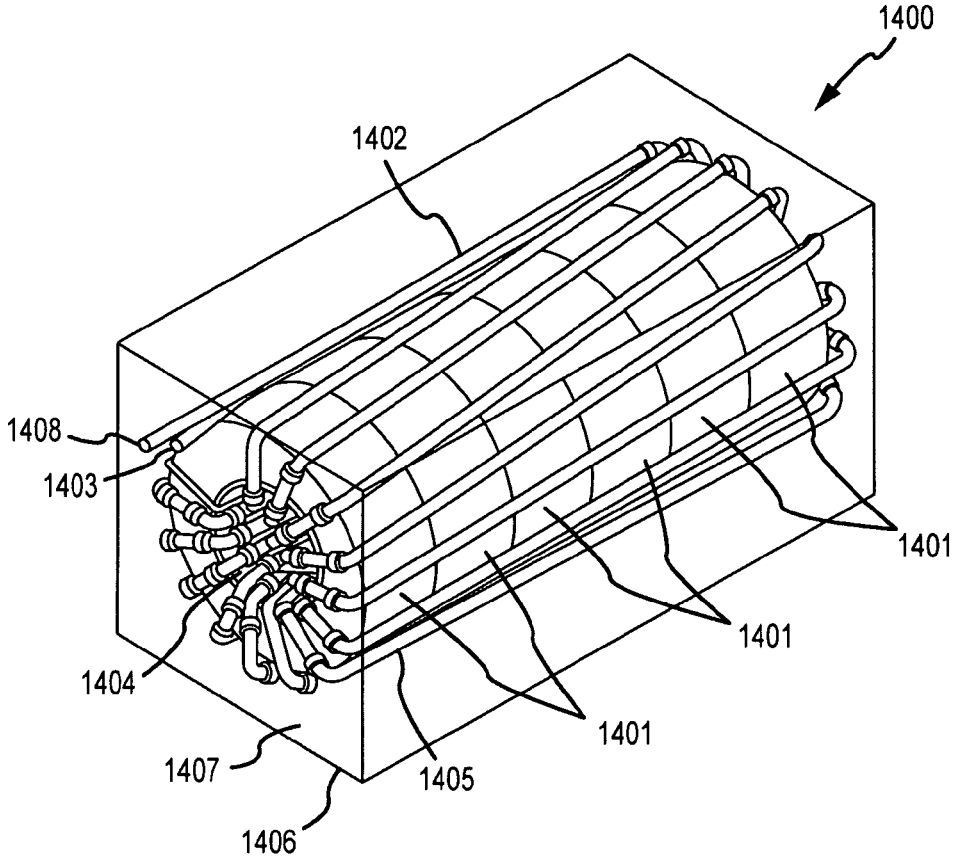
Figure 15B:
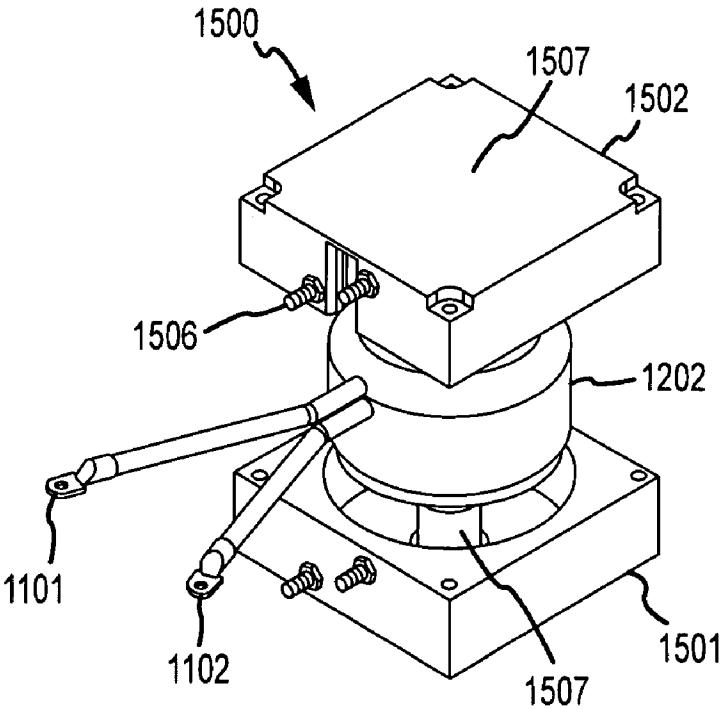
Figure 15A:
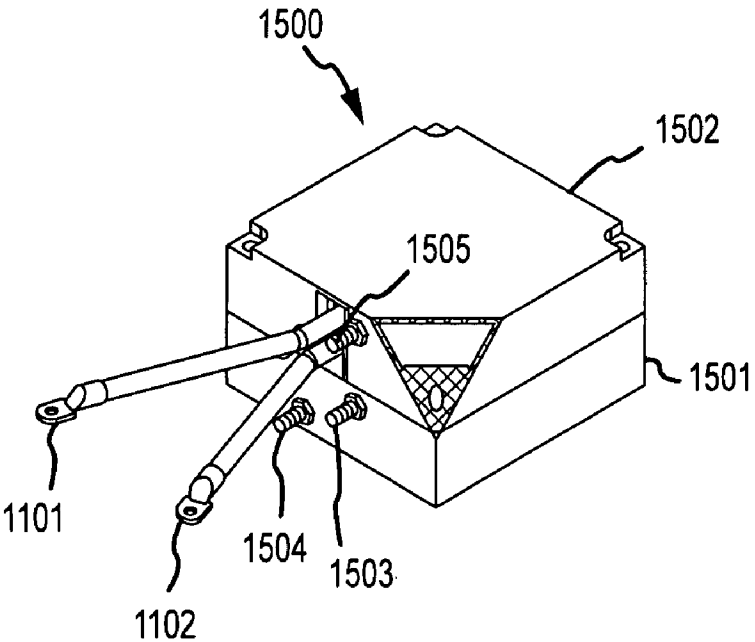

FIGS. 4A-B are diagrams of an inductor including a layered winding;

FIGS. 5A-B are perspective views of a set of inductors and a conventional inductor configuration, respectively;

FIG. 6 is a diagram showing an exemplary inductor configuration;

FIGS. 7A-B are a perspective view and a cross-sectional view, respectively, of a hybrid core;

FIG. 8 is a representation of an electrical system including a coolant system;

FIG. 9 is an illustration of various aspects of an exemplary electrical system including a coolant system;

FIG. 10 illustrates in an exploded view a cooling system for an inductor;

FIG. 11 illustrates an electrical inverter/converter system;

FIG. 12 illustrates a cooling system;

FIG. 13 illustrates a cross-sectional view of an exemplary cooling system about an electrical inverter/converter system;

FIG. 14 illustrates a cooling system about multiple substantially circular cores, and FIGS. 15A-B represents an exemplary core and cooling system.

A more complete understanding of the present invention is derived by referring to the detailed description and claims when considered in connection with the illustrative figures. In the figures, like reference numbers refer to similar elements and steps.

Elements and steps in the figures are illustrated for simplicity and clarity and have not necessarily been rendered according to any particular sequence. For example, steps that are performed concurrently or in different order are illustrated in the figures to help improve understanding of embodiments of the present invention.

DETAILED DESCRIPTION OF THE INVENTION

The present invention is described partly in terms of functional components and various assembly and/or operating steps. Such functional components are realized by any number of components configured to perform the specified functions and achieve the various results. For example, the present invention optionally includes various elements, materials, windings, cores, filters, supplies, loads, passive, and active components, which carry out a variety of functions. In addition, the present invention may be practiced in conjunction with any number of applications, environments, and passive circuit elements. The systems and components described are merely exemplary applications for the invention. Further, the present invention may incorporate any number of conventional techniques for manufacturing, assembling, connecting, operating, and the like.

Figure 1A:
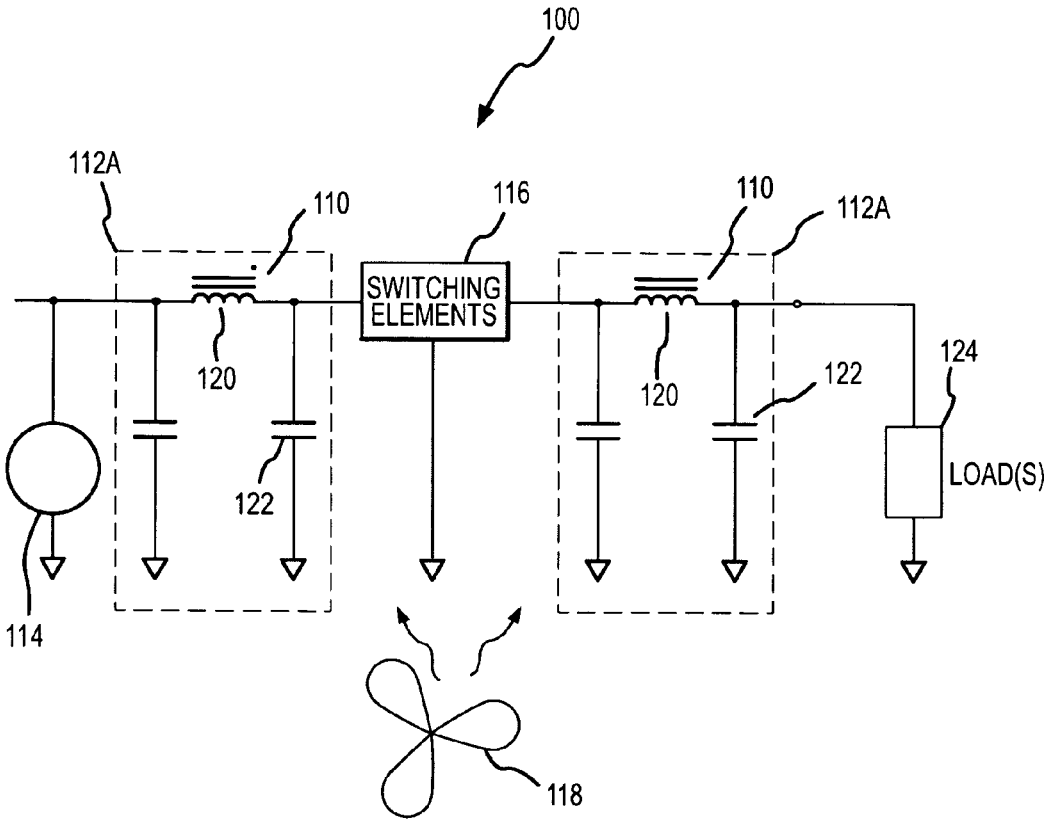
FIGS. 1A and 1B are block diagrams of electrical systems.
Figure 1B:
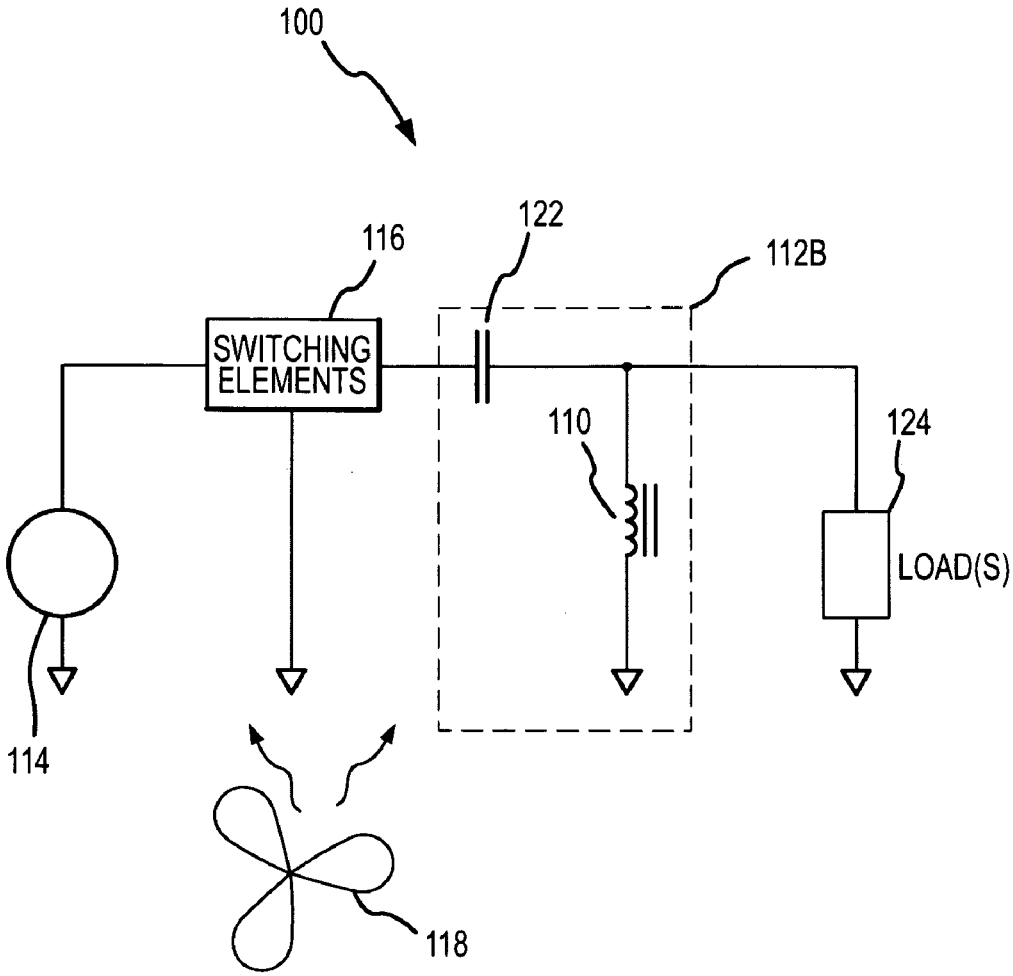

Referring now to FIGS. 1A-B, an electrical system 100 according to various aspects of the present invention includes an electromagnetic component 110 operating in conjunction with an electric current to create a magnetic field, such as with a transformer and/or an inductor. In the present embodiment, the electrical system 100 comprises a power supply system having a filter circuit 112, such as a low pass filter 112A or a high pass filter 112B. The power supply comprises any suitable power supply, such as a supply for medical equipment, an uninterruptible power supply, a backup power supply, a variable speed drive, an adjustable speed drive, high frequency inverters or converters, or other suitable applications or loads 124.

The electrical system 100 may comprise, however, any system using the electromagnetic component 110. Electrical systems 100 comprising the electromagnetic component 110 are adaptable for any suitable application or environment, such as variable speed drive systems, uninterruptible power supplies, backup power systems, inverters, and/or converters for renewable energy systems, hybrid energy vehicles, tractors, cranes, trucks and other machinery using fuel cells, batteries, hydrogen, wind, solar and other hybrid energy sources, regeneration drive systems for motors, motor testing regenerative systems and other inverter and/or converter applications. Backup power systems may include, for example, superconducting magnets, batteries, flywheel, and DVAR technology. Renewable energy systems may include, for example, solar, fuel cell, wind turbine, hydrogen, and natural gas turbines.

In various embodiments, the electrical system 100 is adaptable for energy storage or generation systems using direct current (DC) or alternating current (AC) electricity configured to backup, store, or generate distributed power. Various aspects of the present invention are particularly suitable for high current applications, such as currents greater than about 100 amperes (A), such as currents greater than about 200 A, and more particularly currents greater than about 400 A, as well as to electrical systems exhibiting multiple combined signals, such as one or more pulse width modulated (PWM) higher frequency signals superimposed on a lower frequency waveform. For example, a switching element may generate a PWM ripple on a main supply waveform. Such electrical systems operating at currents greater than about 100 A operate within a field of art substantially different than low power electrical systems, such as those operating at sub-ampere levels or at about 2, 5, 10, 20 or 50 amperes.

Various aspects of the present invention may be adapted for high-current inverters and converters. An inverter may produce alternating current from direct current (DC). A converter may process AC or DC power to provide a different electrical waveform. The term converter denotes a mechanism for either processing AC power into DC power, which is a rectifier, or deriving power with an AC waveform from DC power, which is an inverter. An inverter/converter system is either an inverter system or a converter system. Converters are used for many applications, such as rectification from AC to supply electrochemical processes with large controlled levels of direct current, rectification of AC to DC followed by inversion to a controlled frequency of AC to supply variable-speed AC motors, interfacing DC power sources, such as fuel cells and photoelectric devices, to AC distribution systems, production of DC from AC power for subway and streetcar systems, and for controlled DC voltage for speed-control of DC motors in numerous industrial applications, and transmission of DC electric power between rectifier stations and inverter stations within AC generation and transmission networks In one embodiment, the supply provides a high AC current to a load 124. The power supply system includes any other appropriate elements or systems, such as a voltage or current source 114 and a switching system or element 116. The supply may also include a circulating coolant system 118. The supply may further operate in conjunction with various forms of modulation, including pulse width modulation, resonant conversion, quasi-resonant conversion, phase modulation, or any other suitable form of modulation.

The switching elements 116 may comprise any switching elements for the particular application, such as integrated gate bipolar transistors (IGBTs), power field effect transistors (FETs), gate turn off devices (GTOs), silicon controlled rectifiers (SCRs), triacs, thyristors, or other appropriate switches. For example, for high-current power inverters and converters, the switching elements 116 may include a thyristor, which is a silicon-controlled rectifier. Thyristors are often employed in converter applications due to their ruggedness, reliability, and compactness. The switching elements 116 may comprise any appropriate elements for making and breaking a circuit, however, such as conventional power semiconductor devices for converter circuits. Such semiconductor devices may include thyristors, triacs, gate turn-off devices with the properties of thyristors and the further capability of suppressing current, and power transistors. Such devices are available with ratings from a few watts up to several kilovolts and several kiloamperes. Low voltage and/or low amperage systems do not scale to high voltage and/or high amperage power systems, such as in excess of bout fifty amperes.

The filter circuits 112A, 112B are configured to filter selected components from the supply signal. The selected components comprise any elements to be attenuated or eliminated from the supply signal, such as noise and/or harmonic components, for example to reduce total harmonic distortion. In the present embodiment, the filter circuits 112A, 112B are configured to filter higher frequency harmonics over the fundamental frequency, which is typically DC, 50 Hz, 60 Hz or 400 Hz, such as harmonics over about 300 or 500 Hz in the supply signal; such as harmonics induced by the operating switching frequency of IGBTs and/or any other electrically operated switches. The filter circuits 112A, 112B may comprise passive components including one or more electromagnetic components 110, such as including an inductor-capacitor filter comprising an inductor 120 and a capacitor 122. The values and configuration of the inductor 120 and the capacitor 122 are selected according to any suitable criteria, such as to configure the filter circuits 112A, 112B for a selected cutoff frequency, which determines the frequencies of signal components filtered by the filter circuit. The inductor 120 may be configured to operate according to selected characteristics, such as in conjunction with high current without excessive heating or exceeding safety compliance temperature requirements.

Referring to FIGS. 1A-B, 2, and 4A-B, an inductor 120 according to various aspects of the present invention comprises a core 210 and a winding 212. The winding 212 is wrapped around core 210. The core 210 and winding 212 are suitably disposed on or in a mount and/or housing 214 to support the core 210 in any suitable position and/or to conduct heat away from the core 210 and the winding 212. The inductor 210 may also include any additional elements or features, such as other items required in manufacturing.

The core 210 provides mechanical support for the winding 212 and may comprise any suitable core 210 for providing the desired magnetic permeability and/or other characteristics. The configuration and materials of the core 210 may be selected according to any suitable criteria, such as BH curve profiles, permeability, availability, cost, operating characteristics in various environments, ability to withstand various conditions, heat generation, thermal aging, thermal impedance, thermal coefficient of expansion, curie temperature, tensile strength, core losses, and compression strength. For example, the core 210 may configured to exhibit a selected permeability and BH curve. Selecting an appropriate BH curve may allow creation of inductors 120 having smaller components, reduced electromagnetic emissions, reduced core losses, and increased surface area in a given volume compared to inductors using conventional materials, such as laminated silicon steel or conventional silicon iron steel.

Figure 2:
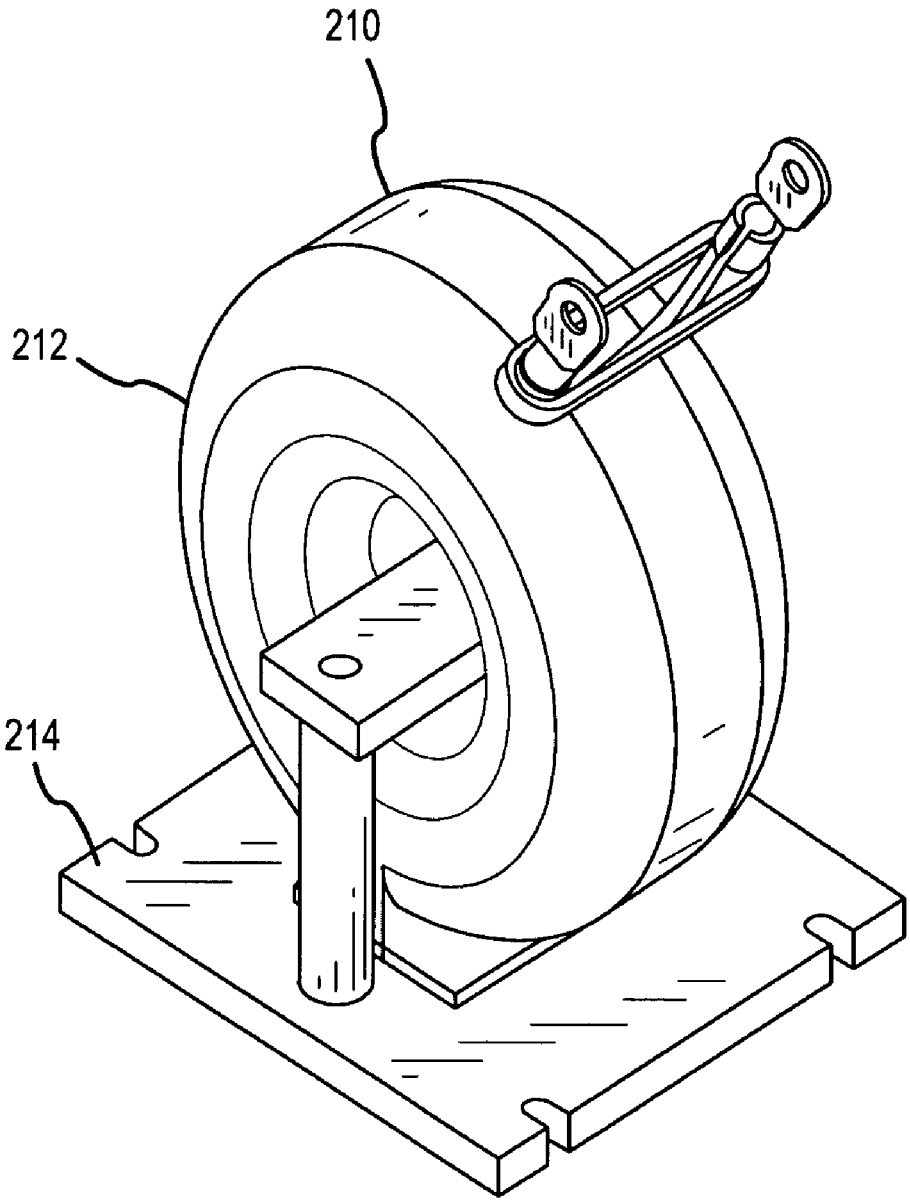
FIG. 2 is a perspective view of an inductor.
Figure 3:
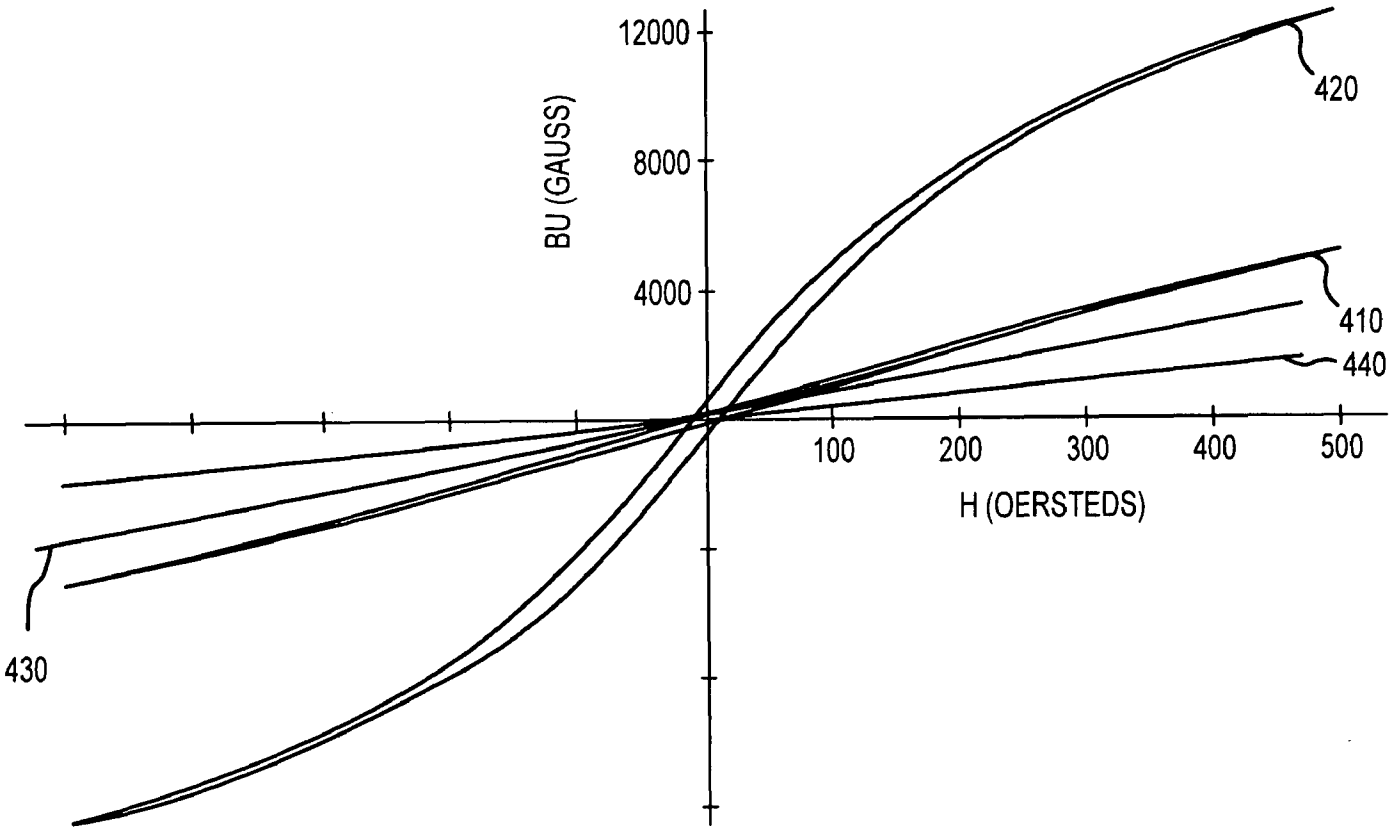
FIG. 3 is an exemplary set of BH curves.

Referring to FIGS. 2 and 3, magnetic field is described in conjunction with two quantities, B and H. The vector field H is the magnetic field intensity or magnetic field strength, also referred to as auxiliary magnetic field or magnetizing field. The vector field H is a function of applied current. The vector field B is known as magnetic flux density or magnetic induction and has the SI units of Teslas (T). Thus, a BH curve is induction, B, as a function of the magnetic field, H.

The permeability of the core 210 may be represented as the slope of $\Delta B/\Delta H$. The core 210 is characterized by the permeability corresponding to a capability for storing a magnetic field in response to current flowing through the winding 212. In the present embodiment, the core 210 is configured to exhibit low core losses under various operating conditions, such as in response to a high frequency pulse width modulation or harmonic ripple, compared to conventional materials, such as laminated silicon steel or silicon iron steel designs. Selecting the appropriate BH curve allows creation of inductors having smaller components, reduced emissions, reduced core losses, and increased surface area in a given volume compared to inductors using conventional materials, such as laminated silicon steel or conventional silicon iron steel.

Referring now to FIG. 2 and Table 1, exemplary inductance B levels for the core 210 as a function of magnetic force strength are provided. The core 210 material may exhibit an inductance of about −4400 to 4400 B over a range of about −400 to 400 H with a slope of about 11 ΔB/ΔH. A linear BH curve corresponds to inductance stability over a range of changing potential loads, from low load to full load to overload. In the present embodiment, the core 210 comprises a material having a substantially linear BH curve with ΔB/ΔH in the range of exactly or about 10 to 12 over the relevant range of current. In another embodiment, the core 210 material exhibits a substantially constant permeability slope of less than nine over a range of −300 to +300 H.

In other embodiments, core materials having a substantially linear BH curve with a permeability ΔB/ΔH in the range of exactly or about 9 to 13 may be employed. Alternatively, the inductor 120 may exhibit a permeability of less than seven delta Gauss per delta Oersted at a load of four hundred Oersteds, a permeability in the range of four to six delta Gauss per delta Oersted at a load of four hundred Oersteds, or a permeability in the range of four to nine delta Gauss per delta Oersted over loads ranging from one hundred to four hundred Oersteds.

TABLE 1

Typical Permeability 11 BH Response

| B (Tesla/Gauss) | H (Oersted) |
|---|---|
| −4400 | −400 |
| −2200 | −200 |
| −1100 | −100 |
| 1100 | 100 |
| 2200 | 200 |
| 4400 | 400 |

The core 210 may comprise any appropriate material meeting the desired permeability and BH curve requirements, such as an iron powder material or multiple materials to provide a particular BH curve. For example, the core 210 may comprise pressed carbonyl powder material with a permeability of about ten. In the present embodiment configured for smaller components, reduced electromagnetic emissions, reduced core losses, and increased surface area in a given volume, the core may comprise a pressed powdered iron alloy material, such as a Material Mix No. -2, referred to as "dash two", or Mix -14, referred to as "dash fourteen", from MicroMetals, Inc. (Anaheim, Calif.). The values in Table 1 approximate the BH characteristics of the dash two material, which exhibits a substantially linear flux density response to magnetizing forces over a large range with very low residual flux, Br. In one embodiment, the core 210 material exhibits a residual flux of about thirty-six Gauss.

Referring again to FIGS. 2 and 3, a BH curve 420 for a conventional silicon, iron lamination core configuration having no central opening has a substantially non-linear permeability curve 420, exhibiting a linear slope from approximately −100 to 100 H and substantially falling off of the linear slope defined in the −100 to 100 H range at higher applied loads, such as above 100 or below −100 H. A BH curve for the Micrometals -2 or -14 material 410 has a substantially linear permeability with a slope of about 11.

Using the dash two or dash fourteen materials also substantially reduces core losses at frequencies of greater than 300 Hz or 500 Hz of the electrical switches compared to silicon iron steel used in conventional iron core inductor design. Thus, a pressed powder core 210 of dash two or dash fourteen materials, or other materials exhibiting such characteristics, surrounded by windings 212 results in substantially reduced heat generation and electromagnetic emissions.

The core 210 may also include a gap, which may affect the permeability of the core 210. In the present embodiment, the core 210 may comprise a pressed powdered iron alloy material, which forms a distributed gap introduced by the powdered material and one or more bonding agents. Substantially even distribution of the bonding agent within the iron powder of the core results in the equally distributed gap of the core.

The core 210 may include no gap, a distributed gap, multiple gaps, or a single gap. Conventional inductor construction requires gaps in the magnetic path of the steel lamination, which are typically outside the coil construction and are, therefore, unshielded from emitting flux, causing electromagnetic radiation. The electromagnetic radiation can adversely affect the electrical system. In the present embodiment, the distributed gaps in the magnetic path of the present core 210 material are microscopic and substantially evenly distributed throughout the core 210. The significantly smaller flux energy at each gap location is also surrounded by the winding 212, which acts as an electromagnetic shield to contain the flux energy.

The gap may affect the permeability of the core 210 material. Referring still to FIGS. 2 and 3, BH curves 430, 440 for pressed powder alloy or powder cores mixed with a bonding agent also exhibit substantially linear permeabilities of approximately eight and four, respectively. The BH curves haying permeabilities of eight and four have a substantially equally distributed gap on the scale of the bonding agent spacing within the powder particles and operate with a nearly linear slope over applied loads from −300 to 300 H and operate with a substantially linear flux density response over a range of magnetizing force strengths, such as about −400 to 400 H, thus producing a near constant inductance value over the full operating range of the power system. For example, the core 210 corresponding to curve 440 comprised of pressed powder cores has a substantially constant slope, indicating substantially linear permeability, compared to the slope of the conventional core material BH curve 420, which has a non-linear permeability in response to changing magnetizing force. Further, the core material for curve 440 has a lower permeability compared to the Micrometals -2 material.

in addition, the core 210 may comprise a hybrid core including multiple materials. For example, the permeabilities of the multiple materials may differ, and the materials may be arranged in may appropriate manner to achieve selected core characteristics. The relative amounts of each material may also be varied, ranging from about 1 to 99 percent of the volume of the core 210. The core 210 may comprise any number of different materials formed in any arrangement to achieve desired characteristics.

For example, referring to FIGS. 1, 2, and 7A-B, the core 210 may comprise a first material 910, such as the Micrometals -2 material, and a second higher permeability material 920, yielding a composite material having a BH curve optimized for performance, weight, size, and cost. In one embodiment, the core 210 comprises the Micrometals -2 material joined by a bonded joint 930 to the higher permeability material 920. Thus, the hybrid core 210 provides a magnetic path having a hybrid or custom BH curve. The hybrid core 210 may exhibit reduced core loss compared to a core made entirely of the higher permeability material 920, while still exhibiting acceptable saturation characteristics in its corresponding BH curve under load and/or overload condition. The hybrid core 210 may provide advantageous characteristics compared to conventional silicon iron steel. For example, the hybrid core 210 may yield engineering solutions in applications where the inductance desired cannot be met in using only Micrometals -2 or -14 materials in the required volume of space.

For core 210 materials having low permeability, such as the Micrometals -2 or -14 materials, the winding 212 may require additional turns compared to higher permeability cores to achieve desired electrical characteristics. In some embodiments, the filter circuits 112A and 112B include multiple inductors 120 configured in parallel and/or series to provide the desired inductance characteristics. Multiple inductors 120 are optionally used in other applications, such as to operate in conjunction with a poly-phase, power system where one inductor 120 handles each phase.

The core may be further configured according to any appropriate criteria to meet the requirements of the electrical system 100, for example to maximize the inductance rating $A_L$ of the core 210, enhance heat dissipation, reduce electromagnetic emissions, facilitate winding, optimize size and/or weight, and/or reduce residual capacitances. The core 210 may comprise, for example, a toroid, a square, a rectangle or connected series of rectangles or squares, an E-shape, or other appropriate configuration.

For example, referring to FIGS. 4A-B, the core 210 may comprise a toroid or other substantially annular or circular shape. In the present embodiment, the core 210 comprises a toroid shape of a selected size. The toroid configuration normally exhibits relatively low electromagnetic emissions and provides significant surface area and a curving geometry for increased heat dissipation compared to other core shapes. In addition, the winding 212 may substantially cover the toroid core 210, inhibiting leakage flux from the toroid inductor 120 compared to traditional designs, thus reducing EMI emissions. Further, the windings 212 tend to act as a shield against such emissions. Still further, the lack of corners an edges in the geometry of the windings 212 and the core 210 material are less prone to leakage flux than conventional configurations.

The core 210 may further include a spacer 215, for example comprised of air or other dielectric material. The spacer 215 may be positioned in the body of the annular core between the terminals of the winding 212. The spacer 215 may interrupt the total circumferential annular completion of the core 210. The spacer may comprise any appropriate electrical insulator, such as a non-conductive high temperature-rated material reducing. The spacer 215 may reduce the change in voltage with time potential of the winding 212 and minimize the turn-to-turn capacitance of the winding 212.

The winding 212 comprises a conductor for conducting electrical current through the inductor. The winding 212 comprises any suitable material for conducting current, such as conventional magnet wire, foil, twisted cables, and the like formed of copper, aluminum, gold, silver, electrically conductive material, or alloy. In the present embodiment, the winding 212 comprises copper magnet wire wound around the core 210 in one or more layers. The magnet wire may comprise multiple strands of round wire, which may maximize the amount of copper cross section in a given volume of toroid core. The round wires efficiently fill the available space to minimize the amount of air between copper wire conductors as compared to square or rectangular shape conductors.

Additionally, the winding 212 may further comprise any other suitable material, and the type and configuration of winding 212 and the number of turns and layers are selected according to the desired characteristics of the inductor 120. For example, the winding 212 may comprise multiple strands of conductor in one or more layers. In one embodiment, referring to FIG. 4B, the winding 212 comprises a first conductor 216 and a second conductor 217, wherein the second conductor 217 is wound on top of the first conductor 216 to minimize the voltage between the two conductors. The winding 212 is suitably wrapped around the smallest diameter of the core 210 in a spiral or any other suitable pattern. In one embodiment, the winding 212 comprises multiple strands of wire, such as about twenty, forty, or sixty strands of 12 or 15 American Wire Gauge (AWG) wire, each of which is wrapped around the smallest diameter of the core 210 individually and co-terminated with the other strands such that all of the strands are wired in parallel.

In addition, the present configuration using round magnet wire wound one layer on top of another layer provides a low effective turn-to-turn voltage. The energy stored may be very low as well. Energy stored corresponds to the capacitance times the square of the voltage applied. The energy stored is reduced by the square of the turn-to-turn voltage reduction, thus reducing energy stored in the present configuration.

Further, the self resonant frequency (SRF) is inversely related to energy stored and is a simple test to confirm low energy stored construction. Maintaining a low turn-to-turn capacitance resulting in a high self resonant frequency may minimize corona deterioration where high rate of change of voltage with time (dV/dt) potential exists in filter inductors that carry switching frequencies as well fundamental line (50/60 Hz) frequencies. The high resonant frequency construction may improve the reliability of the inductor 120. In addition, the winding 212 may utilize specialized magnet wire for use with particular applications, often referred to as inverter grade magnet wire, which may have a secondary silicone or other high dielectric coating in addition to the normal coatings to minimize corona potential.

The inductor 210 may be disposed fully or partially within a housing or on a mount 214. The mount or housing 214 may comprise any system or device adapted to support the core in any position. In addition, the housing 214 may be configurable to direct heat away from the core 210 and/or to protect the core 210 from the elements. The housing 214 may comprise any suitable material, such as a heat conducting material connected to the heat sink 221. The housing 214 is suitably configured to minimize its interference with the winding 212 and improve heat radiation characteristics.

The housing 214 and the inductor 120 are configured to operate in a variety of conditions. In one embodiment, the electromagnetic component 110 may be encased in a thermally conductive compound that acts to both aid in heat dissipation and provide protection from the elements, for example in accordance with standards released by the National Electrical Manufacturers Association (NEMA). In alternative embodiments, the housing 214 comprises a thermal transfer medium, such as a thermally conductive material abutting the inductor 120 to transfer heat away from the inductor 120, which may be thermally connected to a heat sink. The housing 214 is configured in any suitable manner to support and/or transfer heat away from the inductor 120, such as in conjunction with an air and/or liquid cooling system.

The inductor 120 may also be configured to further manage heat generated by the inductor 120. For example, the winding 212 and the core 210 may be configured to effectively dissipate heat, and additional materials, such as housings, heat sinks, potting compounds, and active cooling systems may be added and/or configured to manage heat. In the present embodiment, for example, the toroid configuration of the core 210 has a large surface area available to dissipate heat energy. The large increase in the available winding surface area per cubic volume of the toroid core 210 provides improved heat dissipation compared, for example, to conventional laminated silicon iron steel with concentric wound coils. In addition, the large surface area allows a substantially smaller cross section of copper winding 212 compared to conventional silicon iron steel designs. The reduced winding 212 cross section in the present embodiment yields a design that is substantially smaller, less expensive, more efficient to operate, and lighter for a given inductor and cooling system 118.

For example, referring now to FIGS. 1A-B and 5B, a conventional silicon/iron lamination configuration 620 has no central opening. Consequently, air flow through the center is not possible, inhibiting heat dissipation. Further, the sharp corners and edges disrupt air flow and impede heat dissipation, resulting in poorer performance. Referring now to FIGS. 1A-B and 5A, the substantially circular or toroidal design allows heat dissipation, for example via exposure to forced or unforced air or other cooling system through the geometric middle of the core. Further, the curved edges facilitate the use of air or water based cooling systems, as the rounded edges of the core and windings facilitate smooth flow of the coolant about the inductor 120.

The toroid inductor geometry facilitates forced or unforced airflow through the inside diameter and/or around the outside diameter of the toroid. The rounded shape of the toroid promotes airflow. In addition, the toroid inductor 210 allows the electrical system 100 to use a combination of individual and separately mounted single phase toroids, which are mountable anywhere inside a system cabinet or enclosure to further improve efficiency and reduce airflow restrictions, unlike the conventional configurations where air cannot easily flow through the center, around the sharp edges, and over the larger bulk of traditional multiphase systems.

In addition, the toroidal shape allows for designs having considerably less cross sectional area of conductor in winding 212 for a given current rating compared to traditional non-circular configurations. Because the conductor 212 is on the outside of the core with a large surface area exposed, heat is readily controlled, for example by passive heat dissipation, active cooling elements 118, a high thermal transfer compound, and/or a heat sink. The reduction in conductor size reduces the overall size and weight of the inductor 120.

Referring again to FIGS. 1A and 1B, the electrical system 100 may further include a cooling system 118 to remove heat from the inductor 120. The cooling system 118 comprises any system for cooling the inductor 120 and/or other elements of the electrical system 100, such as one or more fans, a liquid cooling system, and/or a heat sink. In one embodiment, the cooling system 118 comprises a fan blowing air across the inductor 120. In addition, the cooling system 118 may include passive elements, such as a thermally conductive compound applied to the inductor 120, which increases the thermal transfer efficiency from the windings 212 and core 210 to a heat sink.

For example, the electrical system 100 may include a heat sink engaging the inductor 120 to dissipate heat. Referring to FIG. 6, the inductor 120 may be mounted on a heat sink 610 along one or both sides of the inductor 120. When mounted in such a low profile, low airflow configuration, the inductor 120 promotes heat radiation. The heat generating components may be located proximate to the heat radiating elements, unlike considerably larger conventional silicon iron technology, which tends to have many of its hottest components disposed away from a heat sink. The heat sink 610 may be attached or thermally connected to the core 210 and/or the winding 212. The toroid configuration promotes efficient transfer of thermal energy for improved heat dissipation characteristics in low airflow environments and facilitating use of smaller cooling elements and heat sinks 610.

The inductor 120 may also include a thermally conductive compound applied to the inductor 120 to increase the thermal transfer efficiency from the windings 212 and core 210 to the heat sink. The thermally conductive compound may partially or fully encapsulate the inductor 120 or other electromagnetic component and seal it sufficiently to pass the NEMA 4 submersion test described in UL 50 for outdoor use. This allows the unit to stand alone, for example on the outside of a system cabinet. Consequently, the component is suitable for use in NEMA 4 outdoor system applications. The inductor 120 resists shorting due to the floating or ungrounded core of the toroid construction. In addition, outdoor models are optionally configured for the NEMA 4 submersion test in UL 50, for example by vertically mounting the toroid inductor 120 with non-metallic machined parts.

For example, a potting compound about the inductor 120 may to hold the heat sink 610 or housing in close proximity to the inductor 120 and increase thermal conductivity from the winding 212 surface to heat dissipating surfaces. The potting compound may exhibit any appropriate characteristics, such as a high thermal transfer coefficient; resistance to fissure when the mass of the inductor/conductor system has a large internal temperature change, such as greater than about 50, 100, or 150 degrees Centigrade; flexibility so as not to fissure with temperature variations, such as greater than 100 degrees Centigrade, in the potting mass; low thermal impedance between the inductor 120 and heat dissipation elements; sealing characteristics to seal the inductor assembly from the environment such that a unit can conform to various outdoor functions, such as exposure to water and salts; and mechanical integrity for holding the heat dissipating elements and inductor 120 together as a single module at high operating temperatures, such as up to about 150 or 200 degrees Centigrade.

In one embodiment, an electrical system 100 including a fluid cooling system may include cooling lines, which may be over 100 degrees Centigrade cooler than the surface temperature of the magnet wire on the toroid core 210. The two structures may be closer than one-tenth of an inch from each other. The potting compound may thus be selected to perform reliably and efficiently under such conditions or other relevant conditions. Possible potting materials may include Conathane® (Cytec Industries, West Peterson, N.J.), such as Conathane EN-2551, 2553, 2552, 2550, 2534, 2523, 2521, and EN 7-24; Insulcast® (ITW Insulcast, Roseland, N.J.), such as Insulcast 333; Stycast® (Emerson and Cuming, Billerica, Mass.), such as Stycast 281; and epoxy varnish potting compound. Potting material may be mixed with silica sand or aluminum oxide, such as at about thirty to seventy percent, for example about forty-five percent silica sand or aluminum oxide by volume; to create a potting compound with lower thermal impedance.

The cooling system 118 may include an active thermal management system. The active thermal management system circulates a coolant in thermal communication with the inductor 120. The coolant absorbs heat from the inductor 120 and moves the heat away, such as to a heat exchanger where the coolant loses the heat. The active thermal management system may comprise any appropriate system and elements for providing a coolant to the inductor 120.

Referring now to FIG. 8, an exemplary active thermal management system comprises a fluid cooling system 800 including a cooling channel 810, a coolant 812, a heat exchanger 814, and a source 816. The source 816 delivers the relatively cool coolant 812 to the cooling channel 810, which is disposed in thermal communication with the inductor 120 such that heat from the inductor 120 is transferred to the coolant 812. The heated coolant travels to the heat exchanger 814, which removes the heat from the coolant 812. The coolant 812 may then be returned via return pipe 818 to the source 816 for recirculation, or may be discarded.

The coolant 812 absorbs heat from a heat source, such as the inductor 120. The coolant 812 comprises any appropriate coolant, such as a gas, liquid, or suspended solid. For example, the coolant 812 may comprise a conventional coolant, such as water, a colligative agent such as conventional antifreeze, a refrigerant, or a heat transfer fluid. In the present embodiment, the coolant 812 comprises a water/glycerol solution or mixture.

The cooling channel 810 conducts the coolant 812 to the inductor 120. The cooling channel 810 also conducts heat from the inductor 120 to the coolant 812. For example, the cooling channel 810 may comprise a material having a high thermal transfer rate for transferring heat to the coolant 812. The material may be selected for other properties as well, such as electromagnetic shielding effects to reduce the electromagnetic emissions of the inductor 120. The cooling channel 810 may cover or contact as much of the inductor 120 as is practical to remove heat from a large portion of the inductor's 120 surface area. Alternatively, the cooling channel 810 may cover a reduced portion of the inductor's 120 surface.

Referring now to FIGS. 1A-B, 8 and 9, an exemplary cooling system 118 may include the cooling channel 810 comprising a coil of copper, aluminum, stainless steel, or thermally conductive plastic tubing 910 approximately defining a cylinder. The inductor 120 is disposed within the interior of the cylinder. The cooling channel 810 is optionally configured with concentric coils to cover one or both ends 916 of the cylinder to cover the axial ends of the inductor 120. For example, in one embodiment, the cooling channel 810 comprises one or more tubes or other hollow members connected to the source 816 and the heat exchanger 814. In another example, the cooling channel 810 comprises copper, aluminum, stainless steel or thermally conductive plastic tubing 910. The cooling channel 810 is coiled around the inductor 120. The coils may make substantially constant contact with each other as the coils wind around the inductor 120 to optimize the coverage of the cooling channel 810 over the inductor 120. The cooling channel 810 may, however, be otherwise configured, such as in the form of a cast element having interior channels for conducting the coolant 812 and configured to cover one or more surface areas of the inductor 120.

The source 816 provides the coolant 812 to the coding channel 810. The source 816 comprises any appropriate source of coolant 812, such as a water pipe, a pump, a compressor, and the like. In the present embodiment, the source 816 comprises a conventional pump for circulating the coolant 812 through the cooling channel 810 and the heat exchanger 814. If appropriate, the source 816 is configured to pressurize the coolant 812, for example for use in conjunction with a gas coolant, such as a fluorocarbon or a chlorofluorocarbon.

The heat exchanger 814 removes heat from the coolant 812. The heat exchanger 814 comprises any system for removing heat, such as a conventional heat sink, mechanical heat exchanger, fan, or a secondary cooling system. In the present embodiment, the heat exchanger 814 comprises a conventional heat exchanger comprising one or more channels exposed to a cooler environment. In another embodiment, the heat exchanger 814 is optionally omitted, for example by discarding the heated coolant 812.

The thermal management system may comprise additional elements or features according to the environment or application of the electrical system 100. For example, the cooling channel 810 may be disposed within a high thermal transfer rate potting compound 912 to facilitate additional heat transfer away from the inductor 120, while providing electrical isolation. In addition, the cooling channel 810 and/or the potting compound 912 may be mounted on a mounting plate 914 or bracket comprising a high thermal transfer rate material. Further, the volume or configuration of the cooling channel 810 and the delivery rate of the source 816 may be adjusted according to the heat removal requirements of the system, a desired time for reaching thermal equilibrium, and/or other relevant factors.

In the present embodiment, the reduced size of the inductor 120 compared to conventional inductors having similar performance characteristics creates a lower thermal mass, and the heat removal increases the performance of the inductor 120 and facilitates the use of a smaller inductor 120. Further, the inductor 120 and the cooling channel 810 may be sealed within a package, installed in a closed space, or even submerged. The inductor 120 may be configured to meet any relevant requirements, such as those of NEMA, for example to meet the Type 4, 4X, 6, or 6P enclosure standards or other relevant criteria. In another example, combinations of cooling systems are used, such as combinations of air and liquid cooling systems.

Referring now to FIG. 10, an exemplary cooling system 1000 may be adapted for a core 210 having an inner surface 1010, an outer surface 1020, a first end 1030, and a second end 1040. A first cooling element 1050, such as coiled tubing, one or more channels, or a container, forms an inner surface 1052, such as an inner cylindrical surface, and an outer surface 1054, such as an outer cylindrical surface. In this example, the inner cylindrical surface of the first cooling element substantially, thermally, and/or proximally contacts the outer surface of the core 210. An optional second cooling element 1060, such as coiled tubing, one or more channels, or a container, forms an inner side 1062, such as an inner cylindrical side, and an outer side 1064, such as an outer cylindrical side. In this example, the outer cylindrical side of the second cooling element substantially, thermally, and/or proximally contacts the inner surface of the core 210. Optionally third cooling element 1070 and fourth cooling element 1080 substantially, thermally, and/or proximally contact, the first end 1040 and second end 1030 of the core, respectively. Two or more of the first, second, third, and fourth cooling elements are coupled together into one or more cooling channels or lines. One or more of the first, second, third, and fourth cooling elements are integrated into the fluid cooling system 800.

In operation, an electrical system 100 supplies power to the load 124 by generating power via the source 114. The power signal is provided to the switching system 116, for example to regulate the magnitude of the power signal provided to the load 124. The switching system 116 or other sources may, however, introduce harmonics or other noise into the power signal, which may damage or disrupt the load or cause electromagnetic interference (EMI). The filter circuits 112A, 112B filter unwanted components from the power signal, such as harmonics and noise. The power signal is provided to the inductor 120, which establishes a current in the winding 212.

In the present embodiment, the core 210 exhibits low core losses in response to high frequencies as compared to silicon iron steel lamination. Consequently, the inductor 120 generates less heat in response to the harmonics and other higher frequency noise in the power signal. In addition, the exposed surface of the core 210 and of the winding 212 facilitates a lowering of the inductor 120 to air thermal resistance, thus increasing heat dissipation and increasing efficiency, especially in conjunction with the cooling system 118, such as an air and/or liquid cooling system. The low losses of the core 210 material reduce the overall power requirements of the inductor 120, thus reducing the necessary copper density for the winding 212. Moreover, because the inductor 120 accommodates higher frequencies without overheating and accommodates higher currents without saturating, a smaller core 210 reduces heat generation and/or to avoids saturation. The addition of the thermal management system further reduces the effects of heat. Consequently, the inductor 120 is relatively smaller and lighter while achieving the same or better performance.

Example I

In one exemplary embodiment, a high power inverter and/or converter system has an inductor with a substantially annular core, such as a circle, doughnut, or toroid. The annular core has an inner surface and an outer surface. The annular core is composed of at least one material, such as a pressed powder alloy or an iron powder. The pressed powder core is mixed with a bonding agent. Substantially even distribution of the bonding agent within the resultant core results in a substantially equally distributed gap on the scale of the bonding agent spacing within the powder particles.

A conductor substantially contacts the outer surface of the core to form the winding 212. The high power inverter/converter is designed to operate at current levels in excess of 100 amperes, such as in excess of 400 amperes, while yielding a permeability, $\Delta B/\Delta H$, of less than thirteen at an operating load of 400 Oersteds while operating at a frequency of greater than about 500 Hz. Reduced permeability BH curves, such as permeabilities of about 4, 5, 6, 7, 8, 9, or 10 over a range of any combination of −400, −300, −200, −100, 0, 100, 200, 300, and 400 H increase operating efficiency. A cooling system cools one or more sides of the annular core, such as an outer surface, inner surface, a first cap or end-piece, and/or a second cap or end-piece. The inverter/converter system can operate in combination with a poly-phase high voltage power line.

Example II

In a second exemplary embodiment, an inverter and/or converter system is coupled to a cooling system. The cooling system cools one or more sides of the annular core, such as an outer surface, inner surface, a first cap or end-piece, and/or a second cap or end-piece. Referring now to FIG. 11, an illustrative example of a cooling system coupled to an inverter/converter system may comprise a filter inductor and cooling system 1100 of an inverter/converter system. The illustrated system is a 3-core inductor system, which is operable in combination with a poly-phase high voltage power line. The system has an electrical input connection 1101 and an electrical output connection 1102. Coolant runs in through one or more inlet cooling lines 1104, circulates about the core, and runs out through one or more outlet cooling lines 1103. For a three-core system, three parallel cooling systems may be deployed. Multiple isolated cooling systems may also be utilized. Coolant may be distributed into the inlet cooling lines via a coolant inlet manifold 1105 and collected after cooling the core with a coolant outlet manifold 1106.

Referring now to FIGS. 10 and 12, a cooling system 1200 having one or more cooling channels 1201 surrounds an inductor 1202. The cooling channels 1201 may be potted into a closed box 1203 with a potting compound. A single phase assembly mounting plate 1204 may provide a base for the box, and several single phase assembly mounting plates may be attached to a three-phase assembly mounting plate 1205 of the electrical inverter/converter system 100.

Referring now to FIGS. 12 and 13, the cooling system 1200 about a single phase of the electrical inverter/converter system includes the cooling channels 1201 to form an inner diameter surface 1301, outer diameter surface 1302, top cover 1303, and bottom cover 1304 about a wound inductor. The potting material 1305 couples the cooling system 1200 to the wound inductor.

Example III

In yet another example, the cooling system may simultaneously cool multiple cores. Referring now to FIG. 14, a series of six cores 1401 of an inductor/converter system are aligned along a single axis, where a single axis penetrates through a hollow geometric center of each core. The hollow geometric center may be filled with a cooling line and/or a potting material. While six cores are illustrated, any appropriate number of cores may be accommodated. The cooling system 1400 cools the cores. A single cooling line 1402 may run from an inlet 1403, through the center 1404 of each of the cores 1401, and return through a cooling outlet 1408. The single line may be coupled with another or multiple other cooling lines that operate similarly. The cooling system 1400 may be contained in a container 1406, such as a rectangular box, which may be filled with a potting material 1407.

The cooling line 1402 may comprise an electrical/cooling conductor 1405. In the electrical/cooling conductor 1405, a metal tube carries both the current/power and the cooling fluid. For example, a metal, such as copper, aluminum, or stainless steel, cooling line 1405 may transfer codling fluid on the inside and carry current and voltage through the electrically conductive conductor 1405. Thus, the metal tube acts as an electrical conductor with current and voltage running along the outer surface of the metal tube creating resistance heat. At the same time, the conductor portion of the metal acts as a containment for the cooling liquid, allowing the cooling liquid to continually contact the hot inner surface of the metal tube. This maximizes the surface area of the cooling fluid with the hot element of the conductor, thereby minimizing thermal impedance in the cooling system.

Example IV

In another example, multiple inductors, such as substantially circular inductors or toroidal inductors, are individually and independently mounted. In the case of circular inductors, each circular inductor has its own axis of symmetry through the center of the toroid. Independently mounted circular inductors optionally each have separate axes. Similarly, substantially circular inductors and toroidal conductors each have an independent axis, though not necessarily an axis of symmetry. Separately mounted inductors having freedom of position allows placement of multiple inductors in geometries where traditional multiple inductors will not ordinarily fit.

For example, three inductors may be used with a long distance poly-phase high power electrical line. Individual mounting of three inductors associated with the three-phase high power electrical lines allows the system to use a combination of individual and separately mounted single phase toroids, which are mountable anywhere inside a system cabinet or enclosure to further improve efficiency and reduce airflow restrictions. This is made possible by each of the inductors of a poly-phase filter having isolated magnetic paths. This is an advantage over conventional configurations where air cannot easily flow through the center, around the sharp edges, and over the larger bulk of traditional multiphase systems. Conventional poly-phase silicon/iron lamination filter inductors have a single common magnetic path that prevents separately packaging each of the poly-phase elements.

Example V

Referring now to FIGS. 15A-B, another example of a cooling system/wound core configuration 1500 includes a cooling system surrounding or sandwiching a wound core 1202 having an electrical in line 1101 and an electrical out line 1102. FIG. 15A illustrates the cooling system around the wound core and for ease of presentation and explanation, while FIG. 15B illustrates an exploded view of the cooling system about the wound core, such as the system might appear during manufacture. In this example, the cooling system comprises at least two pans, such as a bottom section of a cooling jacket 1501 and a top section of a cooling jacket 1502. The two parts come together to surround or circumferentially surround the wound core 1202 during use. The top and bottom halves join each other along an axis coming down onto the toroid shape of the wound core 1202, referred to as a z-axis. However, the pieces making up the cooling system are optionally assembled in any orientation, such as along x and/or y axes, referring to the axis planes of the toroid.

Further, the top and bottom sections of a cooling jacket 1502, 1501 may be equal in size, or either piece could be from 1 to 99 percent of the mass of the sandwiched pair of pieces. For instance, the bottom piece may make up about 10, 25, 50, 75, or 90 percent of the combined cooling jacket 1502 assembly. Still further, the cooling jacket 1502 may be composed of multiple pieces, such as 3, 4, or more pieces, where the center pieces are rings sandwiched by the top and bottom section of the cooling jacket 1502, 1501.

Generally, any number of cooling pieces can come together along any combination of axes to form a jacket cooling the wound core 1202. Each section of the cooling jacket may contain its own cooling in and cooling out lines. The bottom cooling jacket 1501 contains a cooling in line 1503 and a cooling out line 1504 and the top cooling jacket 1502 contains a second cooling in line 1505 and cooling out line 1506. A center hollow post 1507 in each of the top and bottom sections of the cooling jacket 1502, 1501 aids in extracting heat from the inner diameter of the core. The cooling jackets 1501, 1502 may be seated to the wound core 1202 with use of a potting material. The potting material may be in liquid form during manufacturing and may be poured or injected around and about the cooling system and core, which are both substantially contained in an enclosure. The liquid fills substantially all of the remaining area inside of the enclosure, forcing out air gaps that reduce thermal transfer efficiency. The potting material may form a solid material after setting.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system are not described in detail. Furthermore, the connecting lines shown in the various figures are intended to represent exemplary functional relationships and/or physical couplings between the various elements. Many alternative or additional functional relationships or physical connections are typically present in a complete system but are not integral to the invention described herein.

In the foregoing description, the invention has been described with reference to specific exemplary embodiments; however, various modifications and changes may be made without departing from the scope of the present invention as set forth. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment are optionally executed in any order and are not limited to the explicit order presented in the specific examples. Additionally, the components and/or elements recited in any apparatus embodiment are optionally assembled or otherwise operationally configured in a variety of permutations to produce substantially the same result as the present invention and are accordingly not limited to the specific configuration recited in the specific examples.

Benefits, other advantages, and solutions to problems have been described above with regard to particular embodiments; however, any benefit, advantage, solution to problems, or any element that causes any particular benefit, advantage or solution to occur or to become more pronounced are not to be construed as critical, required, or essential features or components.

The terms "comprises", "comprising", "include", "including", or any variation thereof, are intended to reference a non-exclusive inclusion, such that a process, method, article, composition, or apparatus that includes a list of elements does not include only those elements recited, but also includes other elements not expressly listed or inherent to such process, system, method, article, composition, or apparatus. Other combinations and/or modifications of the above-described structures, arrangements, applications, proportions, elements, materials, or components used in the practice of the present invention, in addition to those not specifically recited, are readily varied or otherwise particularly adapted to specific environments, manufacturing specifications, design parameters, or other operating requirements without departing from the general principles of the same.

The present invention has been described above with reference to exemplary embodiments. Changes and modifications may be made to the exemplary embodiments, however, without departing from the scope of the present invention. These and other changes or modifications are intended to be included within the scope of the present invention as expressed in the following claims.

The invention claimed is:

1. An inverter/converter system, comprising:

an inductor, comprising:

a substantially annular core, comprising:

an inner surface;

an outer surface; and a first core material comprising a distributed gap distributed throughout the first core material; and a winding around the outer surface of the core, wherein:

the system is configured to operate at current levels in excess of about one hundred amperes;

the inductor exhibits a permeability of less than thirteen delta Gauss per delta Oersted at a load of four hundred Oersteds; and the inductor is configured to receive an alternating current of greater than about five hundred Hertz.

2. The inverter/converter system of claim 1, wherein the core comprises:

a pressed iron powder alloy; and a bonding agent substantially evenly distributed through the first core material.

3. The inverter/converter system of claim 2, wherein the winding comprises:

multiple strands of wire wrapped around the core; and a first terminal and a second terminal, wherein at least two of the multiple strands of wire connect in parallel between the first terminal and the second terminal.

4. The inverter/converter system of claim 3, further comprising a spacer disposed within the first core material and interrupting total circumferential annular completion of the substantially annular core, wherein the spacer comprises a non-conductive high temperature-rated material reducing change in voltage with time potential of the winding and minimizing turn-to-turn capacitance of the winding.

5. The inverter/converter system of claim 4, wherein the inductor exhibits a permeability of less than about ten delta Gauss per delta Oersted at a load of four hundred Oersteds.

6. The inverter/converter system of claim 5, wherein the inductor exhibits a permeability of less than seven delta Gauss per delta Oersted at a load of four hundred Oersteds.

7. The inverter/converter system of claim 6, wherein the inductor exhibits a permeability in the range of four to six delta Gauss per delta Oersted at a load of four hundred Oersteds.

8. The inverter/converter system of claim 4, wherein the inductor exhibits a permeability in the range of four to nine delta Gauss per delta Oersted over loads ranging from one hundred to four hundred Oersteds.

9. The inverter/converter system of claim 1, wherein the inductor exhibits a substantially linear inductance from about −4400 B at −400 H to about 4400 B at 400 H.

10. The inverter/converter system of claim 1, wherein the core exhibits a substantially linear flux density response to magnetizing forces over a range of −400 to 400 H.

11. The inverter/converter system of claim 1, wherein the first core material comprises a pressed carbonyl powder material with a permeability of about ten.

12. The inverter/converter system of claim 1, wherein the core is characterized by a permeability for storing a magnetic field in response to current flowing through the winding.

13. The inverter/converter system of claim 1, wherein the core further comprises:

a surface defining central opening in the core; and rounded outer edges, wherein the core comprises a substantially toroidal core.

14. The inverter/converter system of claim 13, further comprising a cooling system comprising at least one cooling channel configured to transport a coolant, wherein the at least one cooling channel substantially defines a cylinder with an interior and an exterior surface, wherein the inductor contacts the cylinder.

15. The inverter/converter system of claim 14, wherein the inner surface of the core contacts the outer surface of the cylinder.

16. The inverter/converter system of claim 14, wherein the outer surface of the core contacts the inner surface of the cylinder.

17. The inverter/converter system of claim 16, wherein:

the inductor comprises a first end and a second end; and the cooling system further comprises at least two cooling covers in proximate contact with the first end and the second end, respectively, of the inductor.

18. The inverter/converter system of claim 17, further comprising a second cooling system having a cooling element in proximate contact with the inner surface of the core.

19. The inverter/converter system of claim 14, wherein the at least one cooling channel coils around the inductor.

20. The inverter/converter system of claim 17, wherein the cooling system comprises:

a source holding coolant during use, wherein the source delivers the coolant into the at least one cooling channel;

a heat exchanger removing heat from the coolant; and a return pipe connected to the heat exchanger, wherein the return pipe returns the coolant to the source.

21. The inverter/converter system of claim 13, further comprising a cooling system comprising:

a liquid cooling system; and a fan blowing air across the round outer edges of the inductor to cool the inductor.

22. The inverter/converter system of claim 13, further comprising a cooling system comprising a heat dissipation element disposed within the central opening in the core.

23. The inverter/converter system of claim 1, further comprising a cooling system at least partially positioned in a geometric center of the core.

24. The inverter/converter system of claim 1, further comprising a cooling system, wherein the inductor exhibits a substantially linear inductance.

25. The inverter/converter system of claim 1, wherein the core material exhibits a substantially constant permeability slope of less than nine over a range of −300 to +300 H.

26. The inverter/converter system of claim 1, wherein the core material exhibits a residual flux of about thirty-six Gauss.

27. The inverter/converter system of claim 13, further comprising a cooling system blowing air across the round outer edges of the inductor and through the central opening of the conductor.

28. The inverter/converter system of claim 1, wherein the core comprises a hybrid core comprising:

a second core material; and a bonded joint bonding the second core material to the first core material.

29. The inverter/converter system of claim 28, wherein the hybrid core reduces core loss, increases inductance rating, and stores more energy relative to a non-hybrid core.

30. The inverter/converter system of claim 1, wherein:

the core comprises a plurality of toroidal cores;

each of the toroidal cores comprises its own independently aligned axis;

at least two of the toroidal cores are aligned along non-aligned axes;

each of the plurality of toroidal cores is individually mounted in an enclosure;

the individual phase toroids operate in conjunction with a poly-phase power system; and each of the multiple individual phase toroids handles a corresponding phase of the poly-phase power system.

31. The inverter/converter system of claim 3, wherein each of the multiple strands of wire comprise corresponding starts and ends, wherein the starts of the multiple strands of wire co-terminate and the ends of the multiple strands of wire co-terminate.

32. The inverter/converter system of claim 31, wherein a first strand of the multiple strands of wire has a first body and a second strand of wire of the multiple strands of wire has a second body, wherein the first body and the second body are substantially in contact from the starts and the ends.

33. The inverter/converter system of claim 1, further comprising a cooling jacket comprising a bottom section having a first cooling line and a top section having a second cooling line, wherein the cooling jacket substantially surrounds the inductor and the winding.

34. The inverter/converter system of claim 33, further comprising:

an enclosure substantially containing the inductor and the conductor; and a potting material filling substantially all remaining volume inside the enclosure.

35. An inverter/converter system, comprising:

an inductor, comprising:

a substantially circular core, comprising:

an inner surface;

an outer surface; and a mass of a first core material, wherein the first core material comprises a substantially equally distributed gap at a particulate scale throughout the mass of the substantially circular core; and an electrical cooling conductor proximately contacting the inner surface of the core and comprises a tube, comprising:

an outer surface;

a metal cross section; and an inner surface;

wherein the outer surface of the tube operates as a conductor and carries current and voltage, wherein the inner surface of the tube contains coolant used to cool the inductor, wherein, during use, heat generated by the conductor on the outer surface transfers through the metal cross section and is transferred to the coolant.

36. The system of claim 35, wherein the system operates at current levels in excess of about one hundred amperes.

37. The system of claim 36, wherein the inductor exhibits a permeability of less than thirteen delta Gauss per delta Oersted at a load of four hundred Oersteds.

38. The system of claim 37, wherein, during use, a period of alternating current flowing through the inductor is present at greater than about five hundred Hertz.

* * * * *